United States Patent [19]

Pearson

[11] 4,324,206

[45] Apr. 13, 1982

[54] PANEL MOUNTING ARRANGEMENT FOR SQUEEZE CHUTES

[75] Inventor: Laurence B. Pearson, Thedford, Nebr.

[73] Assignee: Pearson's Inc., Thedford, Nebr.

[21] Appl. No.: 166,342

[22] Filed: Jul. 7, 1980

[51] Int. Cl.[3] ..... A61D 3/00

[52] U.S. Cl. ..... 119/99

[58] Field of Search ..... 119/98, 99; 160/208, 160/209; 52/766; 256/24, 73; 49/209, 225

[56] References Cited

U.S. PATENT DOCUMENTS

| | | | |
|---|---|---|---|
| 816,580 | 4/1906 | Hull | 49/225 |
| 1,442,721 | 1/1923 | Gordon | 49/209 |
| 2,593,559 | 4/1952 | Heldenbrand | 119/99 |
| 2,650,567 | 9/1953 | Whitworth | 119/99 |
| 2,773,476 | 12/1956 | Thomas | 119/99 |
| 2,851,993 | 9/1958 | Hettinger | 119/99 |
| 3,221,707 | 12/1965 | Pearson | 119/98 |
| 3,683,864 | 8/1972 | Priefert | 119/99 |
| 3,777,715 | 12/1973 | Hill et al. | 119/99 |
| 4,027,629 | 6/1977 | Pearson | 119/99 |
| 4,191,361 | 3/1980 | Jensen | 256/24 X |

FOREIGN PATENT DOCUMENTS

| | | |
|---|---|---|
| 212175 | of 0000 | Australia . |
| 285240 | 3/1966 | Australia . |

*Primary Examiner*—Gene Mancene
*Assistant Examiner*—Robert P. Swiatek
*Attorney, Agent, or Firm*—Lowe, Kokjer, Kircher, Wharton & Bowman

[57] ABSTRACT

A mounting arrangement for retaining removable side panels on the opposite sides of a livestock squeeze chute. The sides of the squeeze chute have front and back pairs of bracket plates for receiving the front and back edges of the side panels. As the panels are dropped into place, a cam located between the back pair of bracket plates shifts the panels forwardly to position their forward edges between the front pair of bracket plates.

9 Claims, 3 Drawing Figures

PANEL MOUNTING ARRANGEMENT FOR SQUEEZE CHUTES

BACKGROUND AND SUMMARY OF THE INVENTION

This invention relates to an improvement in livestock squeeze chutes of the type shown in U.S. Pat. No. 4,027,629. Although squeeze chutes of this general construction have functioned well for the most part, they have not been wholly without problems. For example, if the animal is to be milked or if work is to be performed on its foot or leg area, the side panels must be removed and they must be replaced following completion of the milking or leg work. In the patented unit, a latch must be manipulated by hand to release the side panels and again when the panels are replaced. As can easily be appreciated, the need to provide a latch complicates the structure of the squeeze chute and adds to the time and difficulty involved in working on animals.

The primary goal of the present invention is to eliminate these problems by providing an improved arrangement for retaining the side panels on a livestock squeeze chute.

More specifically, it is an object of the invention to provide, in a squeeze chute for livestock, an improved panel mounting arrangement which retains the side panels in place without the need for latches or other moving parts.

Another object of the invention is to provide a panel mounting arrangement of the character described wherein the panels are automatically situated properly on the sides of the squeeze chute.

A still further object of the invention is to provide a panel mounting arrangement which permits quick and easy replacement of the side panels.

An additional object of the invention is to provide a panel mounting arrangement which firmly retains the panels in a stable position on the sides of the squeeze chute.

Yet another object of the invention is to provide a panel mounting arrangement which is simple and economical to construct and install and which is well suited for use with various types of squeeze chutes.

Other and further objects of the invention, together with the features of novelty appurtenant thereto, will appear in the course of the following description.

DETAILED DESCRIPTION OF THE INVENTION

Figure 1:
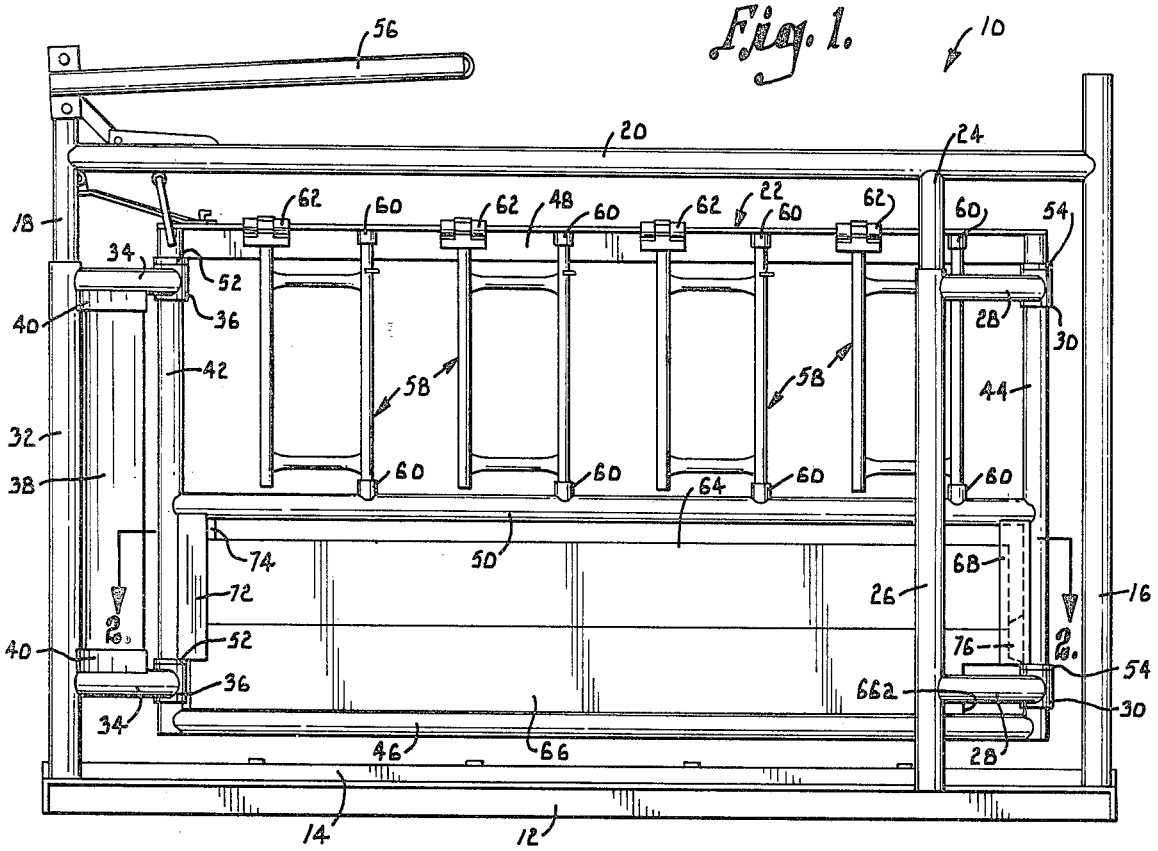
Figure 2:
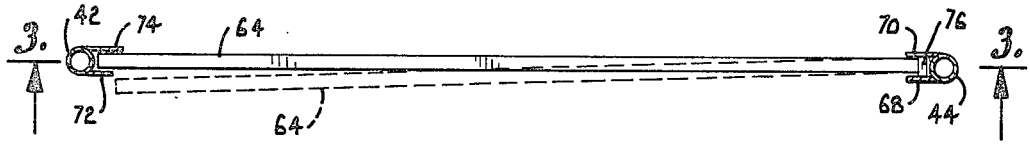
Figure 3:
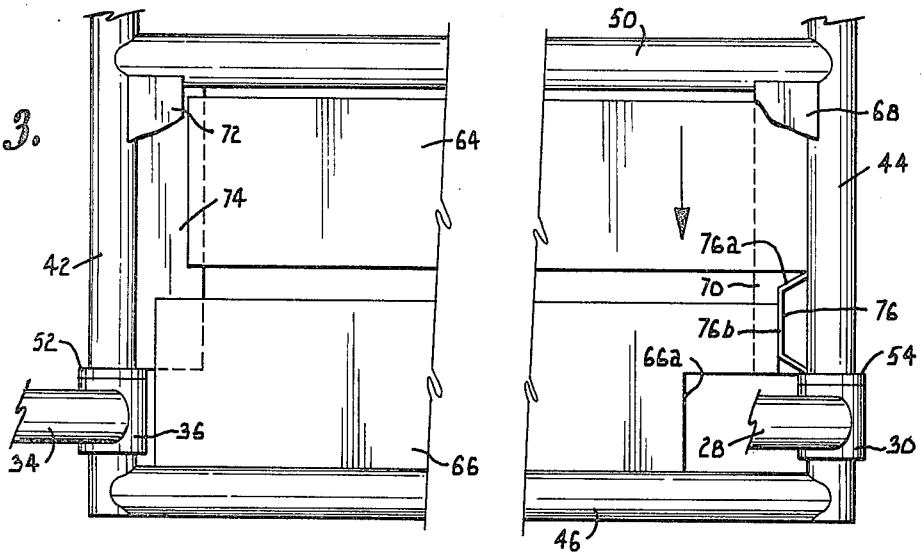

In the accompanying drawings which form a part of the specification and are to be read in conjunction therewith and in which like reference numerals are used to indicate like parts in the various views:

FIG. 1 is a side elevational view of a livestock squeeze chute which is equipped with a panel mounting arrangement constructed according to a preferred embodiment of the present invention;

FIG. 2 is a fragmentary sectional view taken generally along line 2—2 of FIG. 1 in the direction of the arrows, with the broken lines illustrating the position of one of the side panels during installation and removal of the panel from the side of the squeeze chute; and FIG. 3 is an enlarged fragmentary view taken generally along line 3—3 of FIG. 2 in the direction of the arrows and showing the upper panel in a position to be dropped onto the lower panel, with portions broken away for purposes of illustration and the break lines indicating continuous length of the side of the squeeze chute.

With initial reference to FIG. 1, numeral 10 generally designates a livestock squeeze chute of the type shown in U.S. Pat. No. 4,027,629 which is incorporated herein by reference. As described in detail in the aforementioned patent, the squeeze chute 10 has a base 12 which supports a plurality of floor boards 14. A pair of upright posts 16 are mounted on base 10 at the inlet end of the squeeze chute, and another pair of upright posts 18 are mounted on the base at the opposite end of the chute. A horizontal bar 20 extends between each pair of posts 16 and 18 on opposite sides of the squeeze chute.

Animals are squeezed between parallel opposite sides 22 of the squeeze chute which are supported for movement toward and away from one another. The opposite sides 22 are constructed and mounted on the squeeze chute in substantially the same manner. A vertical post 24 extends between base 12 and the upper bar 20 on each side of the unit at a location forwardly of the rear post 16. A tube 26 is sleeved over post 24 and is large enough to turn about the vertical axis of the post. Tube 26 rests on base 12 and is equipped with a pair of horizontal arms 28 carrying sleeves 30 which are in vertical alignment with one another. A similar tube 32 is sleeved on the forward post 18 on each side of the unit. Tube 32 rests on base 12 and is large enough to turn about the axis of the post. A pair of horizontal arms 34 project from the tube 32 in parallel relation to arms 28. A small sleeve 36 is carried on the end of each arm 34.

A removable neckboard 38 is mounted between arms 34. The neckboard 38 is held at its upper and lower edges by brackets 40 secured to the upper and lower arms 34. The neckboard 38 may be lifted out of the lower bracket 40 and removed to provide access to the neck area of an animal in the squeeze chute.

Each of the sides 22 is rectangular and includes an upright bar or post 42 at its front end and another upright bar or post 44 at its back end. Posts 42 and 44 are rigidly connected at the bottom by a horizontal bar 46 and at the top by a horizontal member angle 48. An intermediate bar 50 extends horizontally between the posts 42 and 44 slightly below the center of the side. The forward post 42 is extended through sleeves 36, and the other post 44 is extended through sleeves 30. The sleeves are large enough to turn about the axes of the posts. Collars 52 are welded to post 42 and rest on top of sleeves 36, while another pair of collars 54 are welded to post 44 and rest on top of sleeves 30. Each side 22 is thus mounted on the squeeze chute in a vertical orientation and is maintained parallel to the opposite side. Movement of the sides 22 in unison toward and away from one another is effected by turning a lever 56 which is connected with the sides by the type of linkage disclosed in U.S. Pat. No. 4,027,629.

A plurality of removable bar sections 58 are mounted to each side 22 between angle 48 and the intermediate bar 50. Each bar section 58 may be pivoted within small sleeves 60 which are mounted to angle 48 and to bar 50. Latches 62 supported on angle 48 normally retain the bar sections in the proper positions on the sides.

As thus far described, the squeeze chute is constructed in the same manner as the squeeze chute disclosed in the aforementioned U.S. Pat. No. 4,027,629. In accordance with the present invention, a pair of side panels 64 and 66 are mounted to each side 22 in an improved manner. It is to be understood that the panel mounting arrangement can be used in other types of squeeze chutes as well as in the type illustrated herein.

Each side panel 64 and 66 is slightly shorter than the distance between posts 42 and 44. The lower panel 66 rests on top of bar 46 and is cut away at 66*a* to avoid interfering with movement of arm 28 as sides 22 are moved toward and away from one another. The combined width of panels 64 and 66 is slightly less than the distance between bars 46 and 50.

A pair of parallel bracket plates 68 and 70 are welded or otherwise secured to post 44 to provide a pair of retaining elements which assist in mounting panels 64 and 66 on the side of the squeeze chute. The bracket plates 68 and 70 extend from the lower collar 54 to connection with the intermediate bar 50, and they are spaced apart sufficiently to receive the rear edge portions of panels 64 and 66 in the space presented between the bracket plates. A second pair of parallel bracket plates 72 and 74 provide another pair of retaining elements which cooperate with plates 68 and 70 to mount the side panels on the squeeze chute. Plates 72 and 74 are welded to post 42 and extend from the lower collar 52 to connection with bar 50. Plates 72 and 74 are spaced apart far enough to receive the front edge portions of panel 64 and 66 in the space presented between the plates. As best shown in FIG. 2, the inner bracket plate 74 is wider than the outer bracket plate 72 such that plate 74 projects away from post 40 to a greater extent than plate 72.

Panels 64 and 66 are properly positioned within the bracket plates by a cam 76 which is welded or otherwise secured to post 44 at a location between bracket plates 68 and 70 and immediately above collar 54. Cam 76 has an inclined cam surface 76*a* on its upper portion which angles downwardly as it extends away from post 44. A vertical surface 76*b* is formed on cam 76 at a location below the inclined surface 76*a*. Surface 76*b* is spaced from post 44, and the distance between post 42 and surface 76*b* of the cam is slightly greater than the length dimension of the side panels 64 and 66.

Installation of panels 64 and 66 on sides 22 of the squeeze chute is carried out by first inserting the back edge portion of the lower panel 66 between bracket plates 68 and 70 at a location above cam 76. When the back edge of panel 66 is fully inserted between bracket plates 68 and 70 and against post 44, its front edge can be moved past the edge of bracket plate 72 and into alignment with the space presented between plates 72 and 74. The inner plate 74 is wider than the outer plate 72 and contacts the edge portion of the panel such that the panel cannot be moved inwardly completely past the front bracket plates. When the front edge of the panel is aligned with the space between plates 72 and 74, the panel may be released such that its back lower corner portion engages the inclined cam surface 76*a*. The panel then rides downwardly along surface 76*a* and, by camming action, is moved to the left or forwardly until its front edge portion is inserted between the front bracket plates 72 and 74. When panel 66 has moved downwardly far enough to clear the cam surface 76*a*, its back edge comes into contact with the vertical surface 76*b* which serves to assure that the front edge of the panel is maintained between bracket plates 72 and 74. When fully installed on side 22, the lower panel 66 rests on top of bar 46 and its edges are retained between plates 68 and 70 and plates 72 and 74 to firmly mount the side panel on the squeeze chute.

The upper panel 64 is installed in substantially the same manner. When the back edge portion of panel 64 is fully inserted between plates 68 and 70 at a location above cam 76 as shown in broken lines in FIG. 2, its front edge can be pushed inwardly past plate 72 until it is aligned with a space presented between plates 72 and 74. When panel 64 is then released, it contacts surface 76*a* and is moved forwardly by camming action to the position shown in solid lines in FIG. 2, wherein its front edge is positioned between plates 72 and 74. When fully installed on the squeeze chute, panel 64 rests on top of panel 66 in edge to edge contact therewith. It is noted that a portion of the vertical surface 76*b* projects above the lower panel 66 so that it can contact the back edge of upper panel 64 in order to maintain its front edge between the front bracket plates 72 and 74.

Removal of the side panels is effected by initially raising the upper panel 64 above cam 76 and then moving it to the rear until its front edge can be withdrawn past the edge of bracket plate 72. The upper panel can then simply be pulled forwardly to remove its back edge from between bracket plates 68 and 70. The lower panel 66 can then be lifted above cam 76 and moved to the rear to permit its front edge to clear bracket plate 72. Panel 66 can then be pulled forwardly to withdraw its back edge from between plates 68 and 70. With panels 64 and 66 removed from the unit, the feet, legs and lower body portion of the animal are exposed to permit milking and leg work to be carried out.

It is thus apparent that the mounting arrangement permits the side panels 64 and 66 to be quickly and easily removed from the squeeze chute and replaced thereon even though there is only a limited space presented between the upper panel 64 and the intermediate bar 50. Such removal and replacement can be accomplished conveniently without the need to manipulate latches or any other moving parts. Cam 76 assures that the side panels are automatically situated properly and firmly retained in place on the squeeze chute.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter set forth or shown in the accompanying drawings is to be interpreted as illustrative and not in a limiting sense.

Having thus described the invention, I claim:

1. In a livestock squeeze chute having a pair of spaced apart sides movable toward and away from one another for squeezing of an animal therebetween and a pair of generally vertical bars on at least one of the sides, the improvement comprising:

a panel having opposite ends and a length dimension less than the distance between the vertical bars;

a first pair of panel retaining elements on one of the bars spaced apart from one another sufficiently to receive one end of said panel therebetween;

a second pair of panel retaining elements on the other of the bars spaced apart from one another sufficiently to receive the other end of said panel therebetween;

said first and second pairs of retaining elements being spaced sufficiently to permit insertion of said one end of the panel into the space presented between said first pair of retaining elements and movement of said other end of the panel past an edge portion of one of the retaining elements in said second pair into alignment with the space presented between said second pair of retaining elements; and cam means for shifting said panel in a direction longitudinally of the panel to effect entry of said other end of the panel into the space presented between said second pair of retaining elements with said one end of the panel remaining between said first pair of retaining elements, whereby the retaining elements retain said panel on said at least one side of the squeeze chute.

2. The improvement set forth in claim 1, including a second panel having substantially the same length dimension as the first mentioned panel and adapted to be retained by said retaining elements on top of said first panel in edge to edge contact therewith, said cam means being operable to shift one end of said second panel into the space presented between said second pair of retaining elements with the other end of said second panel disposed between said first pair of retaining elements.

3. The improvement set forth in claim 2, wherein said at least one side of the squeeze chute includes a pair of generally horizontal bars extending between said vertical bars, said first panel resting on one of the horizontal bars and the other horizontal bar being disposed closely above said second panel when the panels are mounted on said at least one side of the chute.

4. The improvement set forth in claim 2, wherein said cam means comprises a cam surface disposed between said first pair of retaining elements and engageable with both of said panels to shift the panels generally toward said second pair or retaining elements by camming action.

5. The improvement set forth in claim 1, wherein the other of the retaining elements in said second pair has an edge portion extending beyond the edge portion of said one retaining element to prevent movement of said other end of the panel past said other retaining element when said one end of the panel is disposed between said first pair of retaining elements.

6. The improvement set forth in claim 1, wherein said cam means include a cam surface between said first pair of retaining elements located to engage said one end of the panel in camming fashion to shift the panel generally toward said other bar in response to lowering of the panel.

7. The improvement set forth in claim 1, wherein said cam means includes a cam mounted adjacent to said one bar between said first pair of retaining elements, said cam having an inclined surface located to engage said one end of the panel to shift the panel generally toward said other bar by camming action when said one end of the panel is lowered within the space between said first pair of retaining elements.

8. The improvement set forth in claim 7, including a generally vertical surface located below said inclined surface and spaced from said one bar, said vertical surface engaging said one end of the panel to retain said other end thereof between said second pair of retaining elements.

9. The improvement set forth in claim 8, wherein said at least one side of the squeeze chute includes upper and lower generally horizontal bars extending between said vertical bars, said lower bar being adapted to support the panel thereon and said upper bar being spaced above said inclined surface sufficiently to permit insertion of said one end of the panel between said first pair of retaining elements at a location above the inclined surface and below the upper bar.

* * * * *